US005769625A

United States Patent [19]

Sher

[11] Patent Number: 5,769,625

[45] Date of Patent: Jun. 23, 1998

[54] SAFETY LIGHTER WITH SMOOTH STRIKER WHEEL EDGES

[75] Inventor: Tak Chi Sher, North Point, Hong Kong

[73] Assignees: Polycity Industrial Limited; Tak Fi International (Holdings) Limited, both of Quarry Bay, Hong Kong

[21] Appl. No.: 745,477

[22] Filed: Nov. 12, 1996

Related U.S. Application Data

[63] Continuation-in-part of Ser. No. 583,214, Jan. 4, 1996, abandoned.

[51] Int. Cl.[6] ..... F23D 11/36

[52] U.S. Cl. ..... 431/153; 431/276

[58] Field of Search ..... 431/153, 276, 431/277

[56] References Cited

U.S. PATENT DOCUMENTS

| | | | |
|---|---|---|---|
| 1,746,949 | 1/1930 | Kollstede | 431/137 X |
| 1,762,079 | 6/1930 | Rubsamen | 431/136 |
| 2,262,806 | 11/1941 | Kempf et al. | 431/137 X |
| 2,795,945 | 6/1957 | Coenders | 431/136 X |
| 3,079,781 | 3/1963 | Virtanen | 431/137 X |
| 3,895,904 | 7/1975 | Kimball | 431/277 |
| 3,966,392 | 6/1976 | Lockwood | 431/277 |
| 4,687,437 | 8/1987 | Springer | 431/277 |
| 4,717,335 | 1/1988 | Loveless | 431/277 |
| 4,822,276 | 4/1989 | Bisbee | 431/277 |
| 5,066,220 | 11/1991 | Vick | 431/277 |
| 5,074,781 | 12/1991 | Fujita | 431/277 X |
| 5,085,578 | 2/1992 | Hunter | 431/277 |
| 5,092,764 | 3/1992 | McDonough et al. | 431/277 |
| 5,096,414 | 3/1992 | Zellweger | 431/277 |
| 5,104,313 | 4/1992 | Zellweger | 431/277 |
| 5,125,829 | 6/1992 | McDonough et al. | 431/153 |
| 5,165,885 | 11/1992 | Iwahori | 431/153 |
| 5,197,870 | 5/1993 | Yang | 431/153 |
| 5,213,493 | 5/1993 | Iwahori | 431/153 |
| 5,213,495 | 5/1993 | Pan | 431/344 |
| 5,215,458 | 6/1993 | Cirami | 431/277 |
| 5,224,854 | 7/1993 | Ansquer | 431/277 |
| 5,271,731 | 12/1993 | Hsin-Chung | 431/254 |
| 5,324,193 | 6/1994 | Pan | 431/277 |
| 5,356,286 | 10/1994 | Sher | 431/153 |
| 5,584,683 | 12/1996 | Sher | 431/153 |

FOREIGN PATENT DOCUMENTS

| | | | |
|---|---|---|---|
| 296281 | 12/1988 | European Pat. Off. | 431/153 |
| 495249 | 10/1919 | France | 431/273 |
| 745844 | 5/1933 | France | 431/273 |
| 819929 | 9/1951 | Germany | 431/136 |
| 1176909 | 8/1964 | Germany | 431/276 |

*Primary Examiner*—Carroll B. Dority
*Attorney, Agent, or Firm*—Ladas & Parry

[57] ABSTRACT

A safety lighter with an improved striker wheel and striker wheel mounting frame. The lighter has an igniter having a striker wheel which rotates about an axis in response to force applied to the wheel by a user's finger. The annular recessed center portion of the striker wheel's outer annular surface has protuberances formed thereon (or grooves formed therein), while the annular unrecessed lateral portions of the striker wheel's outer annular surface are smooth. Further, the striker wheel is mounted to the lighter in slots. The striker wheel is pressed from a first position having insufficient spring force to cause the lighter flint to spark when the striker wheel is rotated into a second position having sufficient spring force to cause the lighter flint to spark when the striker wheel is rotated.

12 Claims, 15 Drawing Sheets

SAFETY LIGHTER WITH SMOOTH STRIKER WHEEL EDGES

CROSS-REFERENCE TO RELATED APPLICATIONS

This is a continuation-in-part of application Ser. No. 08/583,214, filed Jan. 4, 1996 and now abandoned.

FIELD OF THE INVENTION

This invention relates to the field of lighters, such as cigarette lighters.

BACKGROUND OF THE INVENTION

Conventional butane lighters comprise a lighter body within which is housed a reservoir containing butane or other suitable fuel, a mounting frame affixed atop the lighter body, a nozzle inserted through the mounting frame into connected relationship with the reservoir, a lever for actuating the nozzle, and an igniter such as a striker wheel, flint and flint-spring combination, which igniter is positioned close to the rear end of the lever so that the igniter and the rear end of the lever may be actuated nearly simultaneously. The striker wheel has a series of protuberances extending outward from its outer annular surface. The protuberances serve two purposes. One is to provide a surface which will strike against the flint with instantaneously high friction, the other is to provide a gripping surface against which the user's thumb will rest and frictionally engage such that movement of the thumb will cause the striker wheel to rotate. When the user's thumb causes the striker wheel to rotate, the protuberances extending out from the wheel's outer annular surface create sparks upon striking the flint, and a flame is caused to be ignited from the head of the nozzle from which fuel is being ejected while the rear end of the lever is being held down. Note that the purposes of the protuberances will be served if the striker wheel's outer annular surface has grooves formed in it instead of having protuberances extending outward from it.

Lighters which pre-date butane lighters are similar to the above-identified conventional butane lighters except that instead of having a nozzle in connected relationship with the reservoir, a wick or similar device is used, and there is no need for a nozzle actuating lever.

The safety device of the present invention works effectively with either form of lighter.

One of the reasons for the popularity of modem butane lighters is the fact that the height of the flame produced by the lighter can be varied over a wide range by varying the amount of fuel allowed to be ejected from the lighter. The very feature that makes such lighters attractive to the users also makes such lighters dangerous if they are accidentally ignited. When the lighter produces a flame in an uncontrolled circumstance, particularly when the lighter is set on its high setting, materials (such as curtains, clothing, hair) may accidentally be lit on fire. Modern butane lighters are particularly dangerous when they are in the hands of children.

The invention disclosed herein substantially reduces the risk that a lighter will be ignited by a child.

SUMMARY OF THE INVENTION

In a preferred embodiment of the invention, the lighter comprises an igniter having a striker wheel which rotates about an axis in response to force applied to the wheel by a user's thumb (or any other finger or hand part). The striker wheel has an outer annular surface consisting of an annular recessed center portion and annular unrecessed lateral portions.

Only the annular recessed center region of the striker wheel's outer annular surface has protuberances formed thereon (or grooves formed therein), while the annular unrecessed lateral portions of the striker wheel's outer annular surface are smooth.

Another feature of the preferred embodiment of the present invention is the manner in which the striker wheel is attached to the lighter. The striker wheel is mounted to the mounting frame of the lighter by a pair of slots which allow translation of the striker wheel toward and away from the lighter's flint, in addition to the regular rotation of the striker wheel.

In a first embodiment of the present invention, the annular recessed center region may be made deep enough to prevent contact of the annular recessed center region by either a child or an adult.

In a second embodiment of the present invention, the annular recessed center region may be made narrow enough to prevent contact of the annular recessed center region by either a child or an adult.

In a third embodiment of the present invention, the annular recessed center region of the lighter's striker wheel is sufficiently deep enough to prevent a child's finger from being inserted between the annular unrecessed lateral portions. However, this center region is still shallow enough to allow the pulp of an adult's finger to touch and grip the annular recessed center region and to thereby make turning the striker wheel easier for the adult.

In a fourth embodiment of the present invention, the annular unrecessed lateral portions of the lighter's striker wheel are sufficiently close together to prevent a child's finger from being inserted between these annular unrecessed lateral portions. However, these lateral portions are far enough apart to allow the pulp of an adult's finger to touch and grip the annular recessed center region and to thereby make turning the striker wheel easier for the adult.

DETAILED DESCRIPTION OF THE INVENTION

Figure 1:
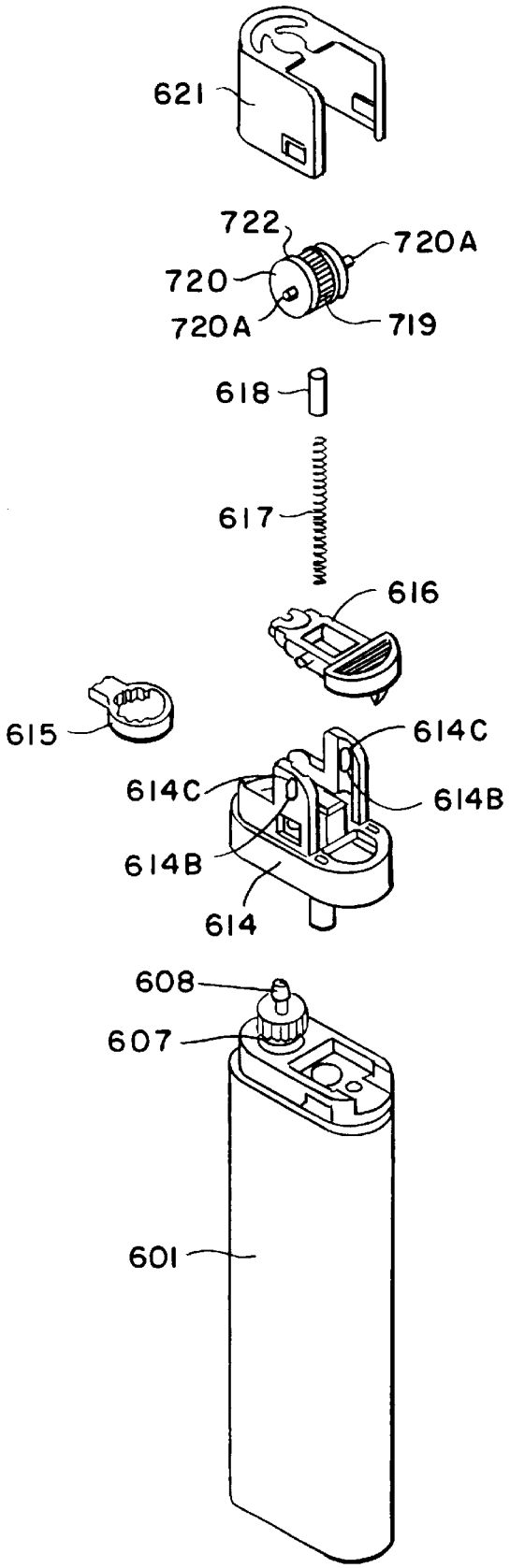
FIG. 1 is an exploded view of the safety lighter of the present invention.

The preferred embodiment of the invention is illustrated in the attached drawings which are referred to herein. The same reference numeral will be used to identify identical elements throughout the drawings.

FIG. 1 illustrates components commonly mounted on a lighter body 601 in which lighter fuel is contained. Such components include nozzle 608 having a head and a downwardly extending tube disposed toward the front of the lighter body, flame adjustment wheel 607 and thumb adjustment actuator 615 which is connected to said flame adjustment wheel, mounting frame 614, windshield 621, nozzle actuating lever 616, and an igniter comprising flint spring 617, flint 618 and striker wheel 720. (Striker wheel 720 and mounting frame 614 shown in FIG. 1 is different from the prior art striker wheels and contains elements of the invention described herein.)

The tube of the nozzle is connected in communicating relationship with the interior of the lighter body where, as mentioned above, fuel is stored. The nozzle may be moved from a lower position to an upper position. When the nozzle is in its lower position, fuel cannot be ejected from it. When the nozzle is in the upper position, fuel is ejected from it. In normal operation, a lighter's striker wheel is rotated and the rear of lever 616 is depressed virtually simultaneously, which causes the nozzle to be raised and a spark to be created when the teeth of the striker wheel fictionally engage the flint 618. The spark ignites the fuel and a flame is maintained so long as the rear of the lever is continued to be depressed downward.

Figure 2:
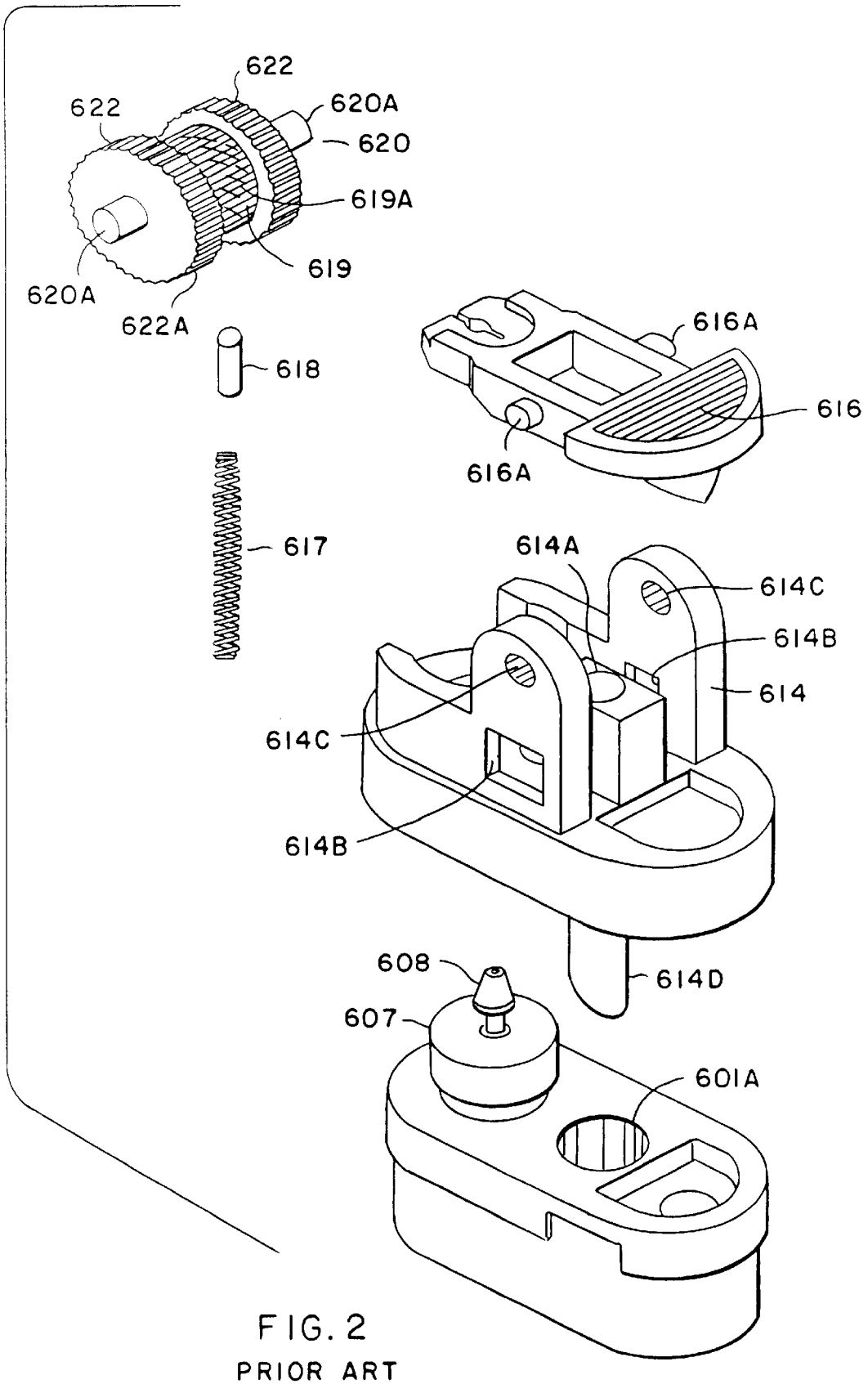
FIG. 2 PRIOR ART
FIG. 2 is a exploded detailed view of a portion of a prior art lighter.
Figure 3:
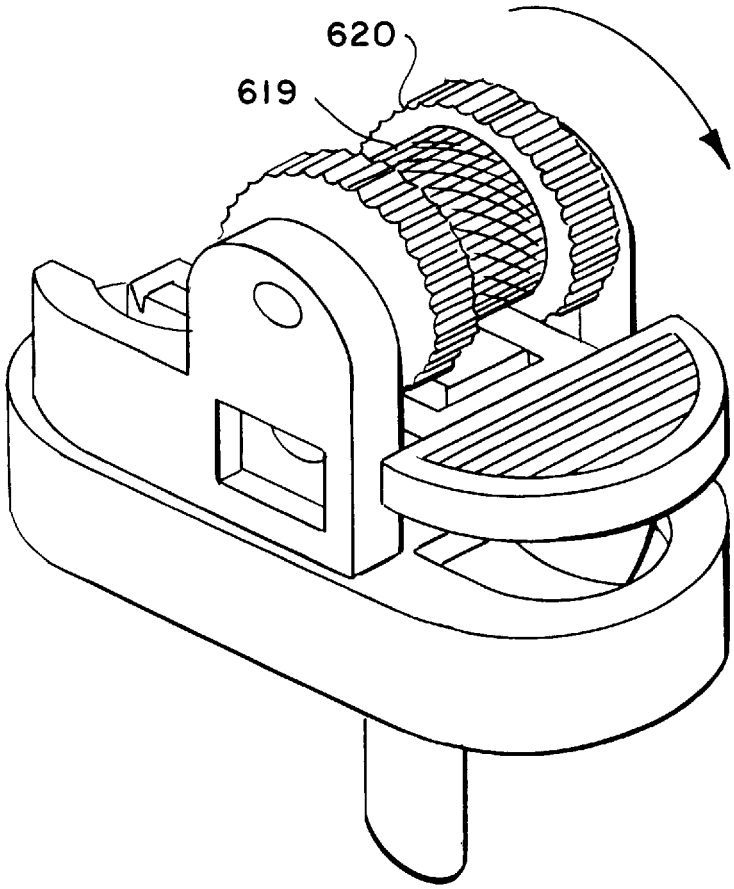
FIG. 3 PRIOR ART
FIG. 3 is a perspective assembled detailed view of a portion of the prior art lighter.
Figure 4:
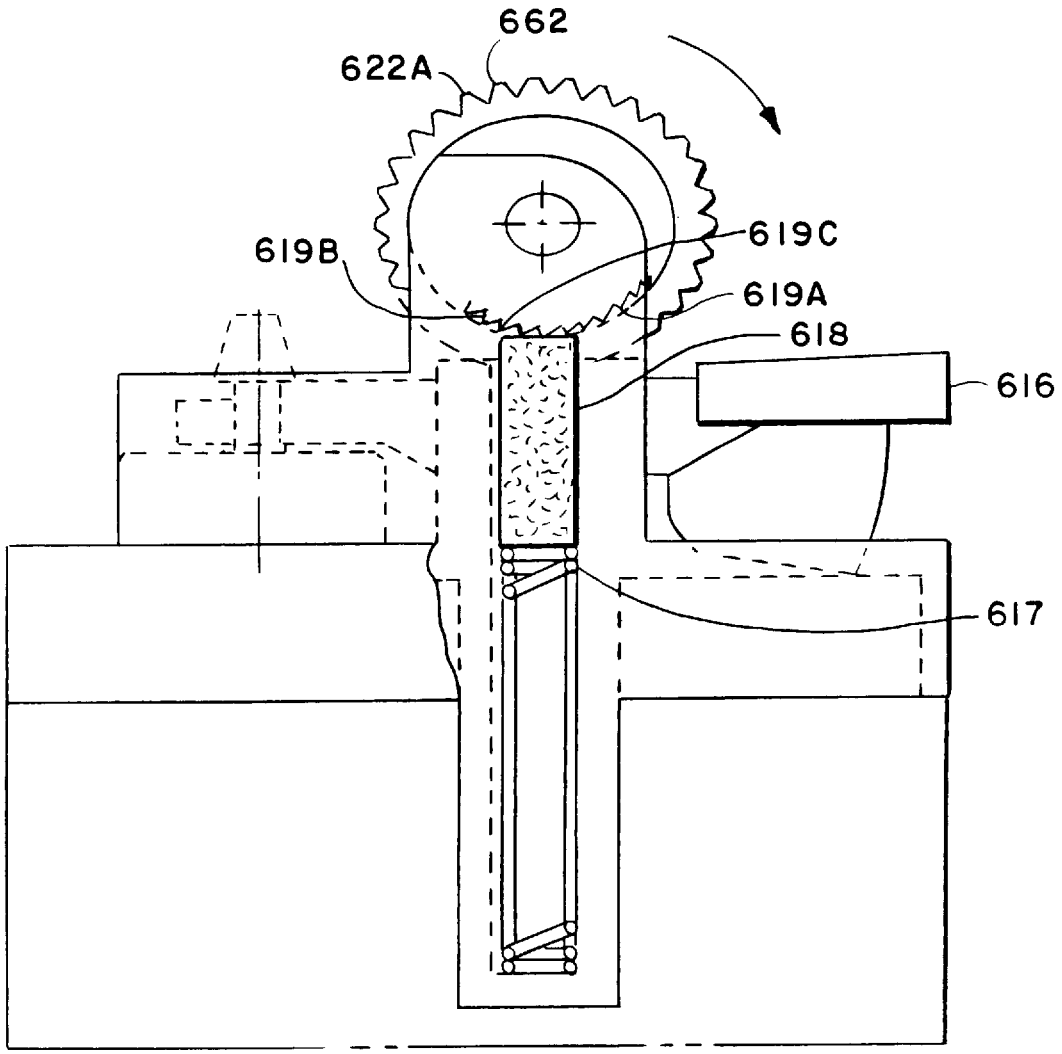
FIG. 4 PRIOR ART
FIG. 4 is a partial side elevational view of the prior art lighter, partially broken away and sectioned.
Figure 5:
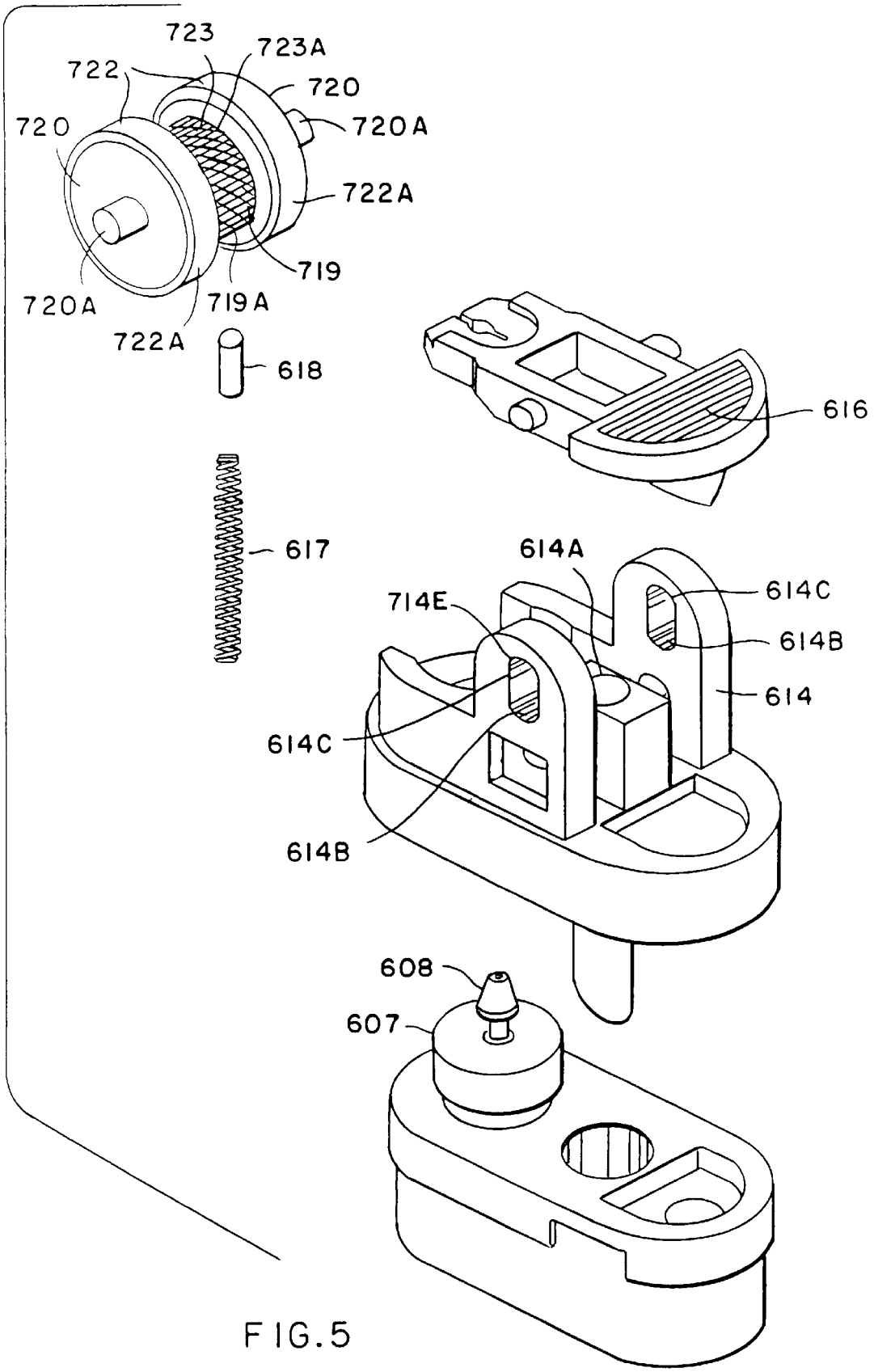
FIG. 5 is an exploded detailed view of that portion of the lighter shown in FIG. 1, and more clearly shows the inventive aspects of the present invention.
Figure 6:
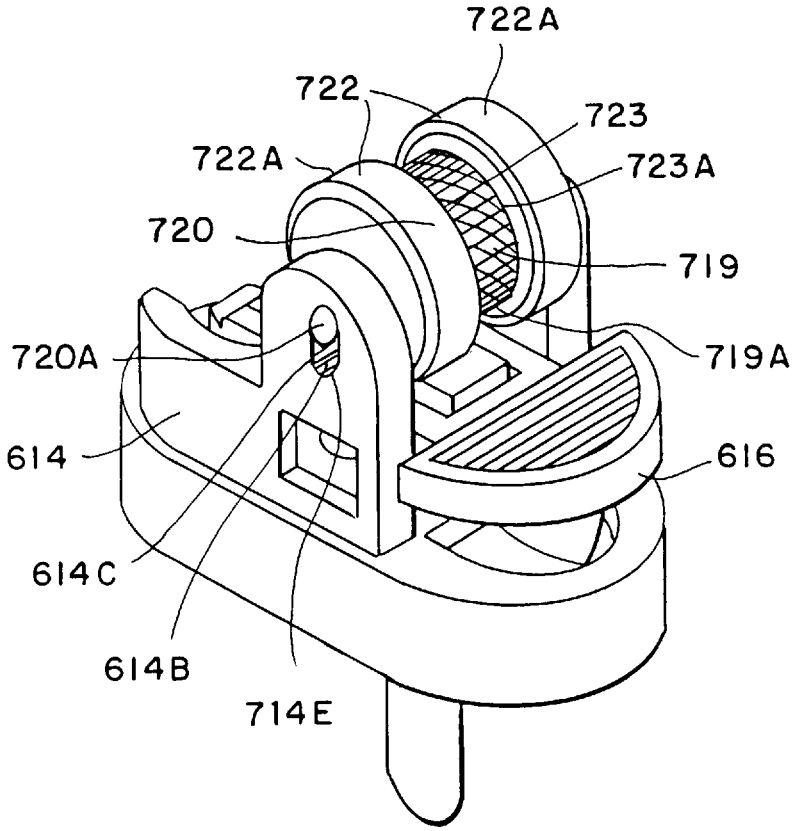
FIG. 6 is a perspective view of the inventive aspects of the invention, showing no pressure being applied to the striker wheel of the lighter.
Figure 7:
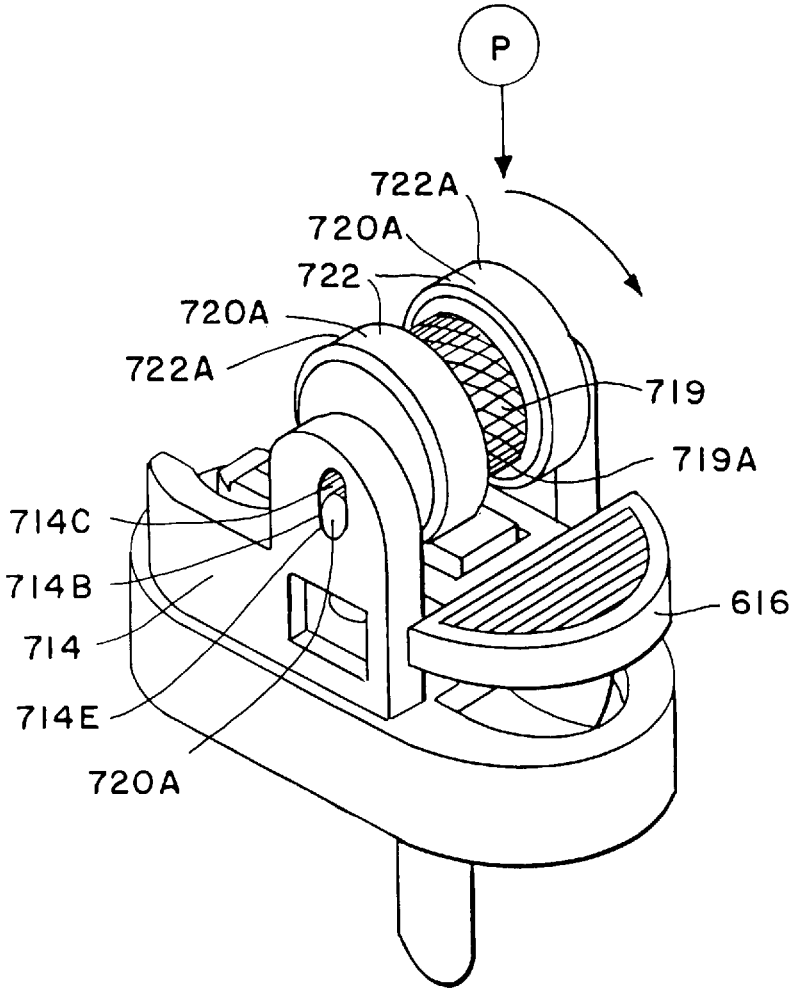
FIG. 7 is the view shown in FIG. 6, but with pressure being applied to the striker wheel of the lighter.
Figure 8:
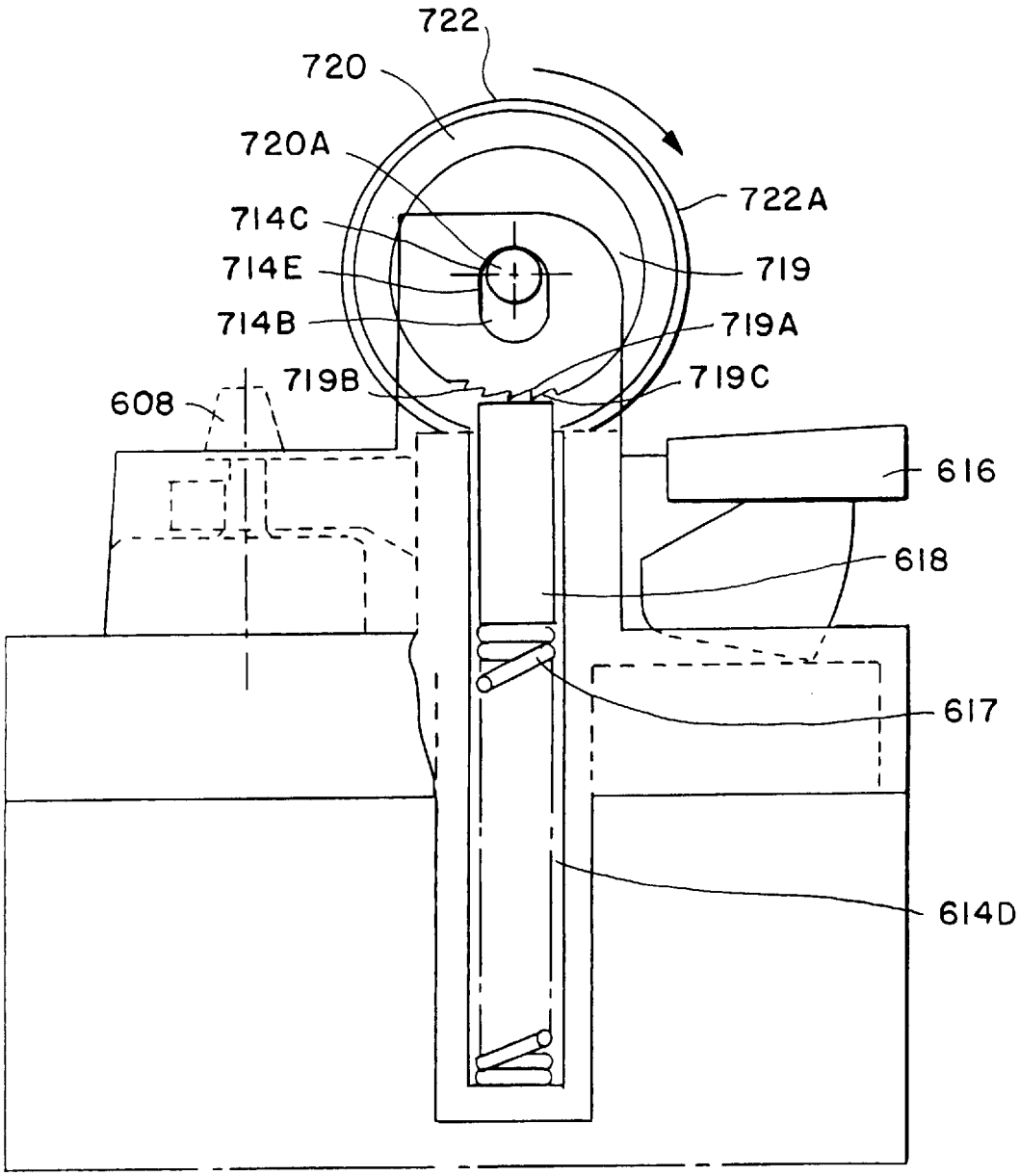
FIG. 8 is a partial side elevational view of the inventive aspects of the invention, partially broken away and sectioned, showing no pressure being applied to the striker wheel of the lighter.
Figure 9:
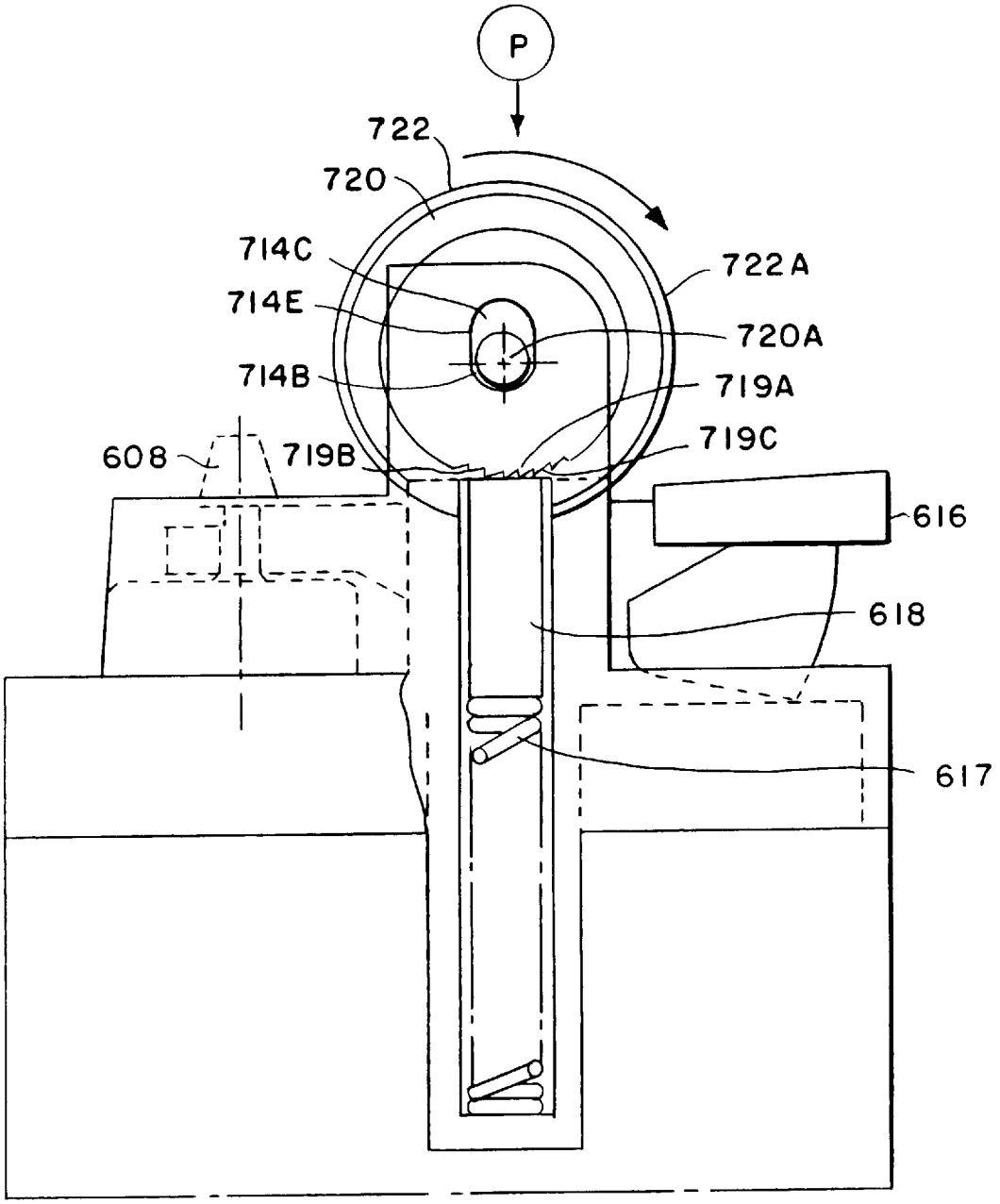
FIG. 9 is the view shown in FIG. 8, but with pressure being applied to the striker wheel of the lighter.

Illustrated in FIGS. 2, 3 and 4 are elements forming a prior art lighter. Frame 614 is mounted on the lighter body with hollow frame stem 614D inserted in hole 601A of the lighter body. Nozzle actuating lever 616 is mounted on the frame with pivots 616A inserted into slots 614B. Striker wheel 620 is formed in the shape of a wheel having a annular center portion 619 of its outer annular surface recessed relative to the annular lateral portions 622 of the striker wheel's outer annular surface. The striker wheel is mounted on frame 614 with the wheel's axis 620A fitting into holes 614C. Flint 618 and flint spring 617 are mounted in hole 614A of the mounting frame in the conventional fashion so as to urge the flint 618 toward protuberances 619A which are disposed on the annular recessed surface 619 of the striker wheel. The lateral portions of the striker wheel's outer annular surface may be viewed as thumb grips 622.

The protuberances 619A on annular recessed center portion 619 are a series of saw-tooth-shaped teeth, each having a first surface 619B which is substantially perpendicular to the tangent of the circle from which the protuberances extend. This first surface faces in the clockwise direction as the lighter is viewed from the side shown in FIG. 4. Each tooth also has a second surface, 619C, which slopes toward the counter-clockwise direction of the wheel when the lighter is viewed from its side with the front (or nozzle) end of the lighter toward the left as shown in FIG. 4. The annular unrecessed lateral portions or thumb grips 622 of the striker wheel of prior art lighters also have protuberances 622A thereon.

The protuberances serve two purposes. The purpose of protuberances 619A is to provide a surface which will strike against the flint with instantaneously high friction. The purpose of protuberances 622A is to provide a gripping surface against which the user's thumb will rest and frictionally engage such that movement of the thumb will cause the striker wheel to rotate. When the user's thumb causes the striker wheel to rotate, the protuberances 619A extending out from the wheel's annular recessed Portion 619 create sparks upon striking the flint, and a flame is caused to be ignited from the head of the nozzle from which fuel is being ejected while the rear end of the lever is being held down.

The purposes of the protuberances will also be served if the striker wheel's annular recessed center portion 619 and its annular unrecessed lateral portions 622 have grooves formed therein instead of having protuberances extending outward therefrom, or if such surfaces are otherwise roughened.

FIGS. 5 through 15 illustrate the present invention. As can be seen, the difference between the present invention and the prior art lighter is in the structure of the striker wheel and the mounting frame. All other elements of the lighters are the same and are assembled and operated the same way.

In many ways the striker wheel 720 of the present invention is similar to the striker wheel 620 of the prior art lighter. Elements 719, 719A, 719B, 719C and 720A of striker wheel 720 each has the same form and function as corresponding elements 619, 619A, 619B, 619C and 620A, respectively, of striker wheel 620. However, where prior art striker wheel 620 has protuberances 622A on annular unrecessed lateral portions 622 of the prior art striker wheel's outer annular surface, the surfaces of annular unrecessed lateral portions 722A of the striker wheel of the present invention are smooth.

Because the annular unrecessed lateral portions 722 of the outer annular surface of the striker wheel of the present invention are smooth, the user must press his or her thumb harder against such portions in order to establish sufficient gripping friction between the thumb and the striker wheel so as to be able to make the striker wheel 720 rotate. The amount of force required to make the striker wheel 720 rotate is within the range of forces capable of being administered by an adult, but beyond the range of forces capable of being administered by a child.

Another feature of the preferred embodiment of the invention is found in the changes to holes 614C of the prior art lighter. In the preferred embodiment, these holes are replaced by slots 714E. Slots 714E permit striker wheel 720 to translate along the length of the slots, which length is substantially parallel to spring 617. By virtue of this configuration, as annular unrecessed lateral portions 722 of striker wheel 720 are depressed, the striker wheel's axis 720A is moved from slot position 714C to slot position 714B. As the striker wheel is thus moved, spring 617 is compressed and exerts an increased force against flint 618, which in turn exerts an increased force against protuberances 719A of the striker wheel's annular recessed center portion 719. When striker wheel axis 720A is in slot position 714C, the force exerted by spring 617 against flint 618, and in turn the force exerted by flint 618 against protuberances 719A is insufficient to create sparks when striker wheel 720 is rotated by the user. However, when striker wheel axis 720A is in slot position 714B, the increased force exerted by spring 617 against flint 618, and in turn the increased force exerted by flint 618 against protuberances 719A is sufficient to create sparks when striker wheel 720 is rotated by the user.

To generate sparks which light the lighter's flame, a user must first exert a force P (shown in FIGS. 7, 9, 12 and 15) against annular unrecessed lateral portions 722 of striker wheel 720, this force P being sufficient to overcome the compressive force exerted by spring 617. This sufficient force P will move axis 720A from position 714C to position 714B, compressing spring 617 and thereby causing spring 617 to exert a greater force against flint 618.

Only in response to this greater force can flint 618 exert a force against protuberances 719A sufficient to generate sparks when striker wheel 720 is rotated by the user. The force P exerted by the user must also be enough to establish sufficient gripping friction between the user's finger and the annular unrecessed lateral portions 722 of striker wheel 720, in order to rotate the striker wheel (as described above). The dexterity required to both press and then rotate striker wheel 720, plus the gripping force required to turn the striker wheel is within the range of dexterity and forces capable of being administered by an adult, but is outside of the range of dexterity and forces capable of being administered by a child.

Figure 10:
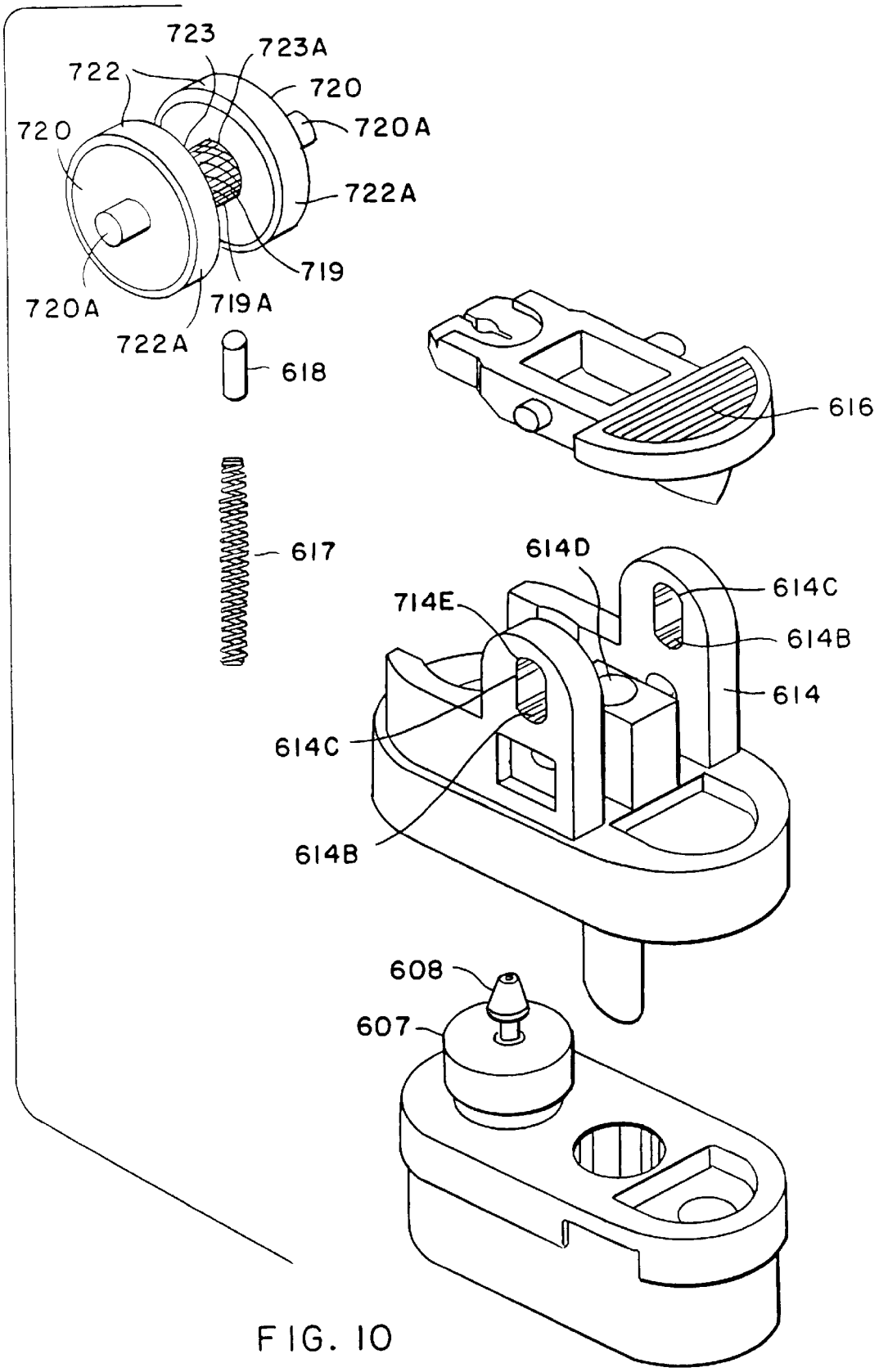
FIG. 10 is an exploded detailed view of that portion of the lighter shown in FIG. 1, and more clearly shows another embodiment of the inventive aspects of the present invention.
Figure 11:
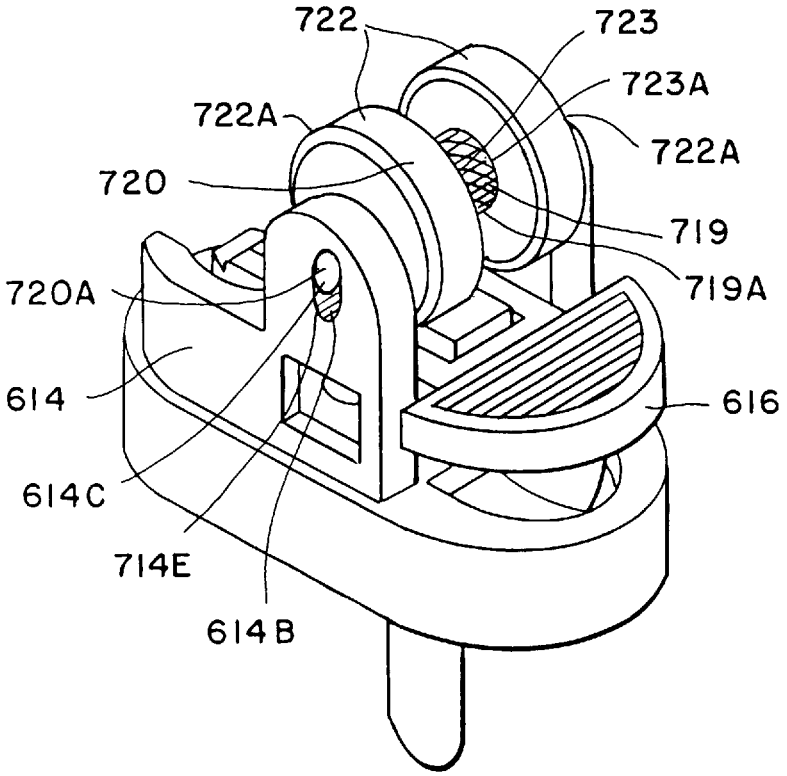
FIG. 11 is an assembled perspective detailed view of the portion of the lighter shown in FIG. 10, showing no pressure being applied to the striker wheel of the lighter.
Figure 12:
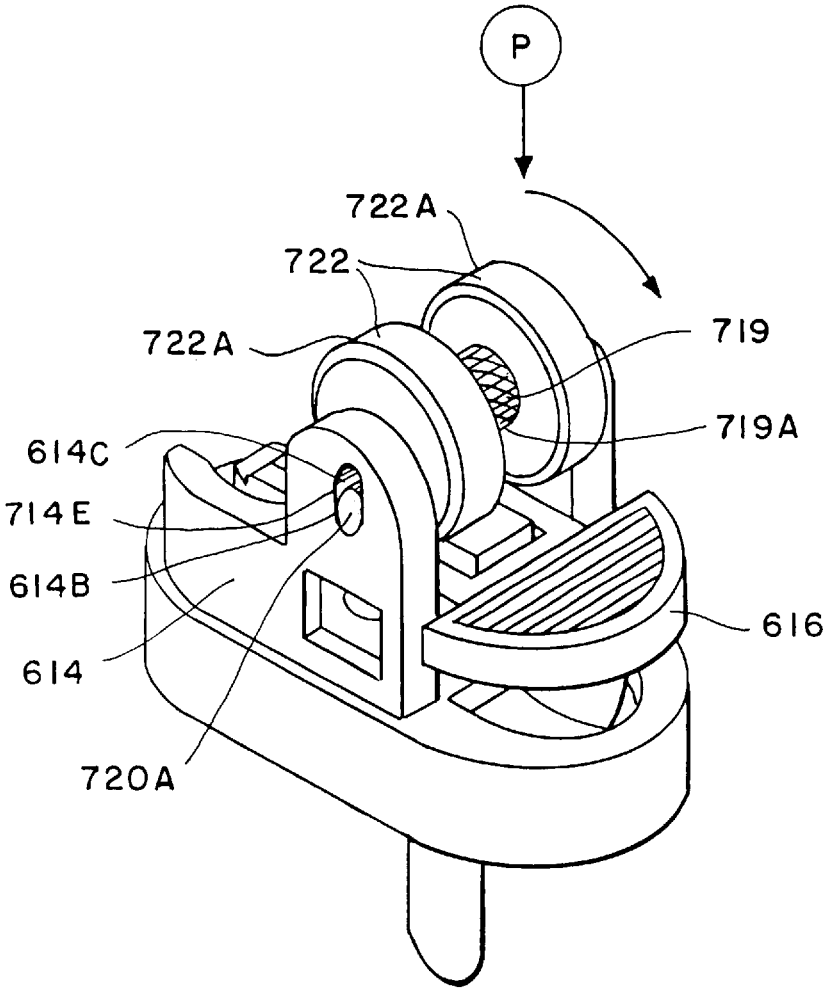
FIG. 12 is the view shown in FIG. 11, but with pressure being applied to the striker wheel of the lighter.

FIGS. 10–12 illustrate a first embodiment of the present invention. In these figures, annular recessed center portion 719 of striker wheel 720 is deepened with respect to annular unrecessed lateral portions 722 of the wheel. This increased depth prevents any user, whether an adult or a child, from being able to contact annular recessed center portion 719 with his or her finger. This feature thereby requires all users to exert the same gripping force (greater than that of the prior art) against annular unrecessed lateral portions 722 to turn striker wheel 720.

It should be noted that a second embodiment of the present invention serves the same purpose and object of the first embodiment just described, but does so by narrowing the annular recessed center portion 719. When this annular recessed center portion is narrowed, it also prevents any user, whether an adult or a child, from being able to contact annular recessed center portion 719 with his or her finger. This feature thereby also requires all users to exert the same gripping force (greater than that of the prior art) against annular unrecessed lateral portions 722 to turn striker wheel 720.

Figure 13:
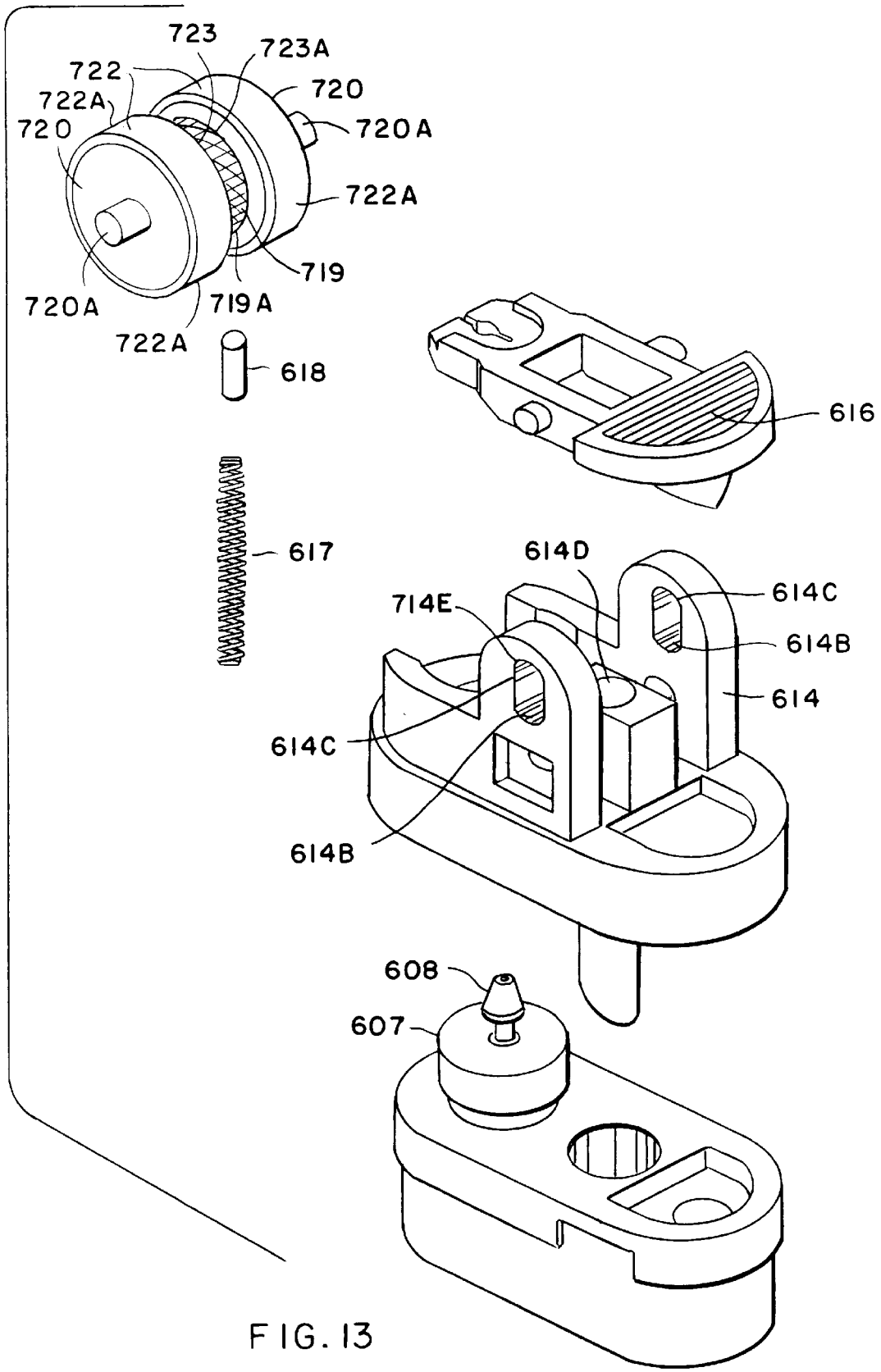
FIG. 13 is an exploded detailed view of that portion of the lighter shown in FIG. 1, and more clearly shows yet another embodiment of the inventive aspects of the present invention.
Figure 14:
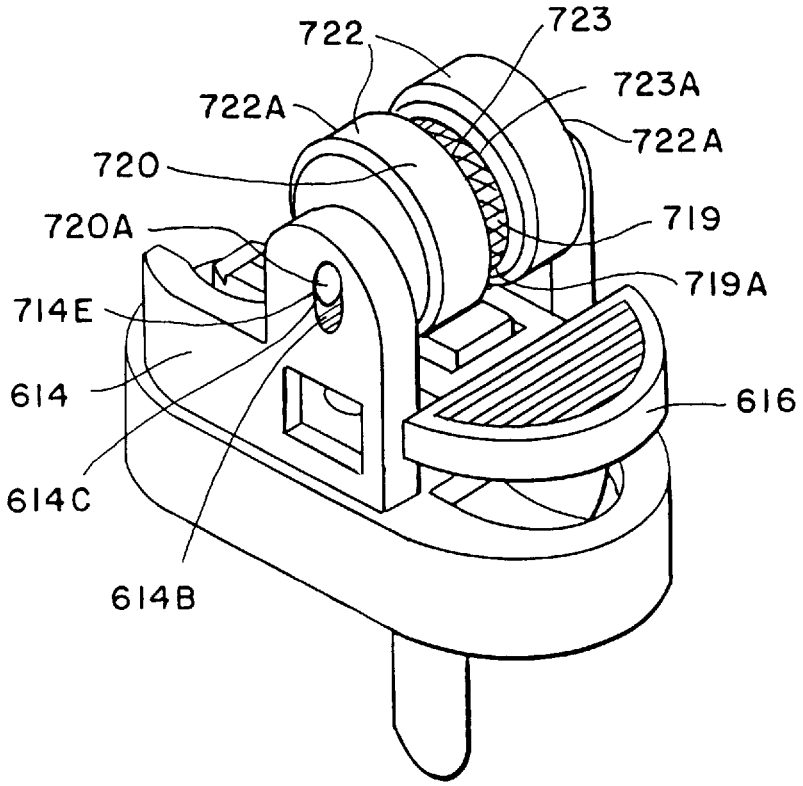
FIG. 14 is an assembled perspective detailed view of the portion of the lighter shown in FIG. 13, showing no pressure being applied to the striker wheel of the lighter.
Figure 15:
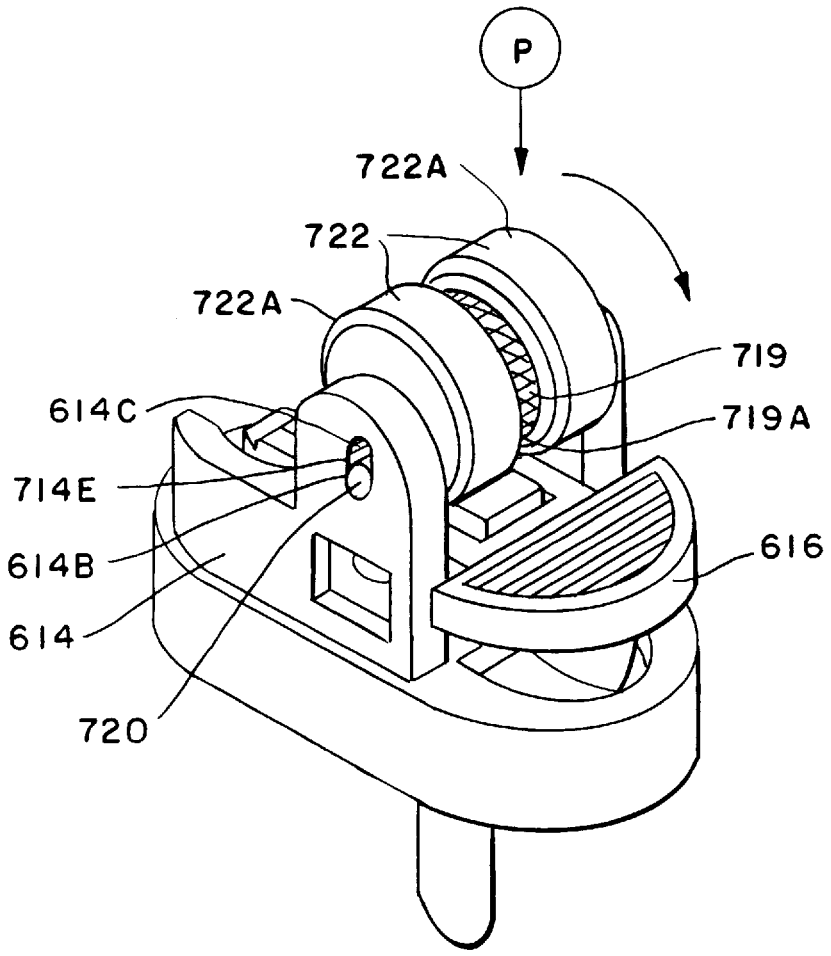
FIG. 15 is the view shown in FIG. 14, but with pressure being applied to the striker wheel of the lighter.

FIGS. 13–15 illustrate a third embodiment of the present invention. In these figures, annular recessed center portion 719 is made shallow. The recessed center portion 719 is shallow enough to allow the pulp of an adult's finger to touch and to grip the annular recessed center portion, yet is deep enough to prevent the finger of a child from contacting the annular recessed center portion. In being able to grip the proturbances 719A of annular recessed center portion 719, the pulp of the adult's finger maintains greater friction against the annular recessed center portion, and thereby makes it easier for the adult to rotate striker wheel 720. The lack of pulp on a child's finger prevents the child from contacting annular recessed center portion 719 and therefore makes it more difficult for the child to rotate striker wheel 720.

It should be noted that a fourth embodiment of the present invention serves the same purpose and object of the third embodiment just described, but does so by narrowing the annular recessed center portion 719. The narrowed annular recessed center portion 719 is narrow enough to prevent the finger of a child from contacting the annular recessed center portion, yet is wide enough to allow the pulp of an adult's finger to contact annular recessed center portion 719. In being able to access and grip the protuberances 719A of annular recessed center portion 719, the pulp of the adult's finger maintains greater friction against the annular recessed center portion, and thereby makes it easier for the adult to rotate striker wheel 720. The lack of pulp on a child's finger prevents the child from contacting annular recessed center portion 719 and therefore makes it more difficult for the child to rotate striker wheel 720.

Above there has been described a unique safety lighter. It should be understood that various changes of the details, materials, arrangements of parts and uses which have been herein described and illustrated in order to explain the nature of the invention will occur to and may be made by those skilled in the art upon the reading of this disclosure, and such changes are intended to be included within the principles and scope of this invention.

I claim:

1. A lighter comprising:

a lighter body having a top end;

a striker wheel, said striker wheel having an axis, and an outer annular surface, said outer annular surface of said striker wheel having an annular recessed center portion with a rough surface formed thereon, and annular unrecessed lateral portions disposed beside said annular recessed center portion, said annular unrecessed lateral portions having smooth surfaces;

a mounting frame attached to the top end of the lighter body, said mounting frame having a complimentary pair of mounting slots formed therethrough to rotatably receive said axis of said striker wheel in a first position and in a second position, and a spring receptacle;

a spring received within the spring receptacle; and a flint;

the spring exerting a compressive force against the flint and forcing the flint into contact with the rough surface of the annular recessed center portion of the striker wheel, the compressive force exerted by the spring being insufficient to cause the flint to generate sparks when the axis of the striker wheel is in the first position and the compressive force exerted by the spring being sufficient to cause the flint to generate sparks when the axis of the striker wheel is in the second position.

2. The lighter of claim 1, wherein the rough surface of the annular recessed center portion comprises protuberances extending outward from the annular recessed central portion of the outer annular surface.

3. The lighter of claim 1, wherein said annular recessed center portion has a depth, the depth being of a size such that the finger of a user is prevented from contacting and gripping the rough surface of the annular recessed center portion of the striker wheel.

4. The lighter of claim 1, wherein said annular recessed center portion has a width, the width being of a size such that the finger of a user is prevented from contacting and gripping the rough surface of the annular recessed center portion.

5. The lighter of claim 1, wherein said annular recessed center portion has a depth, the depth being of a size such that a child's finger is prevented from contacting and gripping the rough surface of the annular recessed center portion, while the pulp of an adult's finger is allowed to contact and grip the rough surface of the annular recessed center portion.

6. The lighter of claim 1, wherein said annular recessed center portion has a width, the width being of a size such that a child's finger is prevented from contacting and gripping the rough surface of the annular recessed center portion, while the pulp of an adult's finger is allowed to contact and grip the rough surface of the annular recessed center portion.

7. A method for manufacturing a safety lighter comprising:

providing a lighter body having a top end;

providing a striker wheel having an axis and an outer annular surface, said outer annular surface of said striker wheel having an annular recessed center portion with a rough surface formed thereon and annular unrecessed lateral portions disposed beside said annular recessed center portion, said annular unrecessed lateral portions having smooth surfaces;

providing a mounting frame with a spring receptacle;

forming a complimentary pair of mounting slots through the mounting frame;

attaching the mounting frame to the top end of the lighter body;

mounting the axis of the striker wheel in the complimentary pair of mounting slots, said complimentary pair of mounting slots providing a first mounting position for the axis and a second mounting position for the axis;

inserting a spring into the spring receptacle;

inserting a flint between the spring and the striker wheel such that the spring exerts a compressive force against the flint and forces the flint into contact with the rough surface of the annular recessed center portion of the striker wheel, the compressive force exerted by the spring being insufficient to cause the flint to generate sparks when the axis of the striker wheel is in the first mounting position and the compressive force exerted by the spring being sufficient to cause the flint to generate sparks when the axis of the striker wheel is in the second mounting position.

8. The method of claim 7, wherein the rough surface of the annular recessed center portion comprises protuberances extending outward from the annular recessed central portion of the outer annular surface.

9. The method of claim 7, wherein said annular recessed center portion has a depth, the depth being of a size such that the finger of a user is prevented from contacting and gripping the rough surface of the annular recessed center portion of the striker wheel.

10. The method of claim 7, wherein said annular recessed center portion has a width, the width being of a size such that the finger of a user is prevented from contacting and gripping the rough surface of the annular recessed center portion.

11. The method of claim 7, wherein said annular recessed center portion has a depth, the depth being of a size such that a child's finger is prevented from contacting and gripping the rough surface of the annular recessed center portion, while the pulp of an adult's finger is allowed to contact and grip the rough surface of the annular recessed center portion.

12. The method of claim 7, wherein said annular recessed center portion has a width, the width being of a size such that a child's finger is prevented from contacting and gripping the rough surface of the annular recessed center portion, while the pulp of an adult's finger is allowed to contact and grip the rough surface of the annular recessed center portion.

* * * * *